United States Patent [19]

Lewis et al.

[11] Patent Number: 4,573,606

[45] Date of Patent: Mar. 4, 1986

[54] AUTOMATIC PILL DISPENSER AND METHOD OF ADMINISTERING MEDICAL PILLS

[75] Inventors: Kermit E. Lewis, R.R. 5, Box 64, Shelbyville, Ind. 46176; Arthur S. Roberts, Jr., Shelbyville, Ind.

[73] Assignee: Kermit E. Lewis, Shelbyville, Ind. ; a part interest

[21] Appl. No.: 530,893

[22] Filed: Sep. 12, 1983

[51] Int. Cl.[4] ..... B65H 29/26

[52] U.S. Cl. ..... 221/2; 221/3; 221/15; 221/197

[58] Field of Search ..... 221/2, 3, 4, 6, 7, 15, 221/82, 83, 76, 69, 197; 206/459; 340/568; 53/507, 508

[56] References Cited

U.S. PATENT DOCUMENTS

| | | | |
|---|---|---|---|
| 747,216 | 12/1903 | Pedersen | 221/83 X |
| 2,626,388 | 1/1953 | Needlman | 340/568 X |
| 2,674,675 | 4/1954 | Lambert | 340/568 X |
| 3,127,055 | 3/1964 | Dew et al. | 221/82 |
| 3,369,697 | 2/1968 | Glucksman et al. | 221/15 X |
| 3,563,410 | 2/1971 | Murray | 221/3 X |
| 3,577,124 | 5/1971 | Kobayashi | 340/568 X |
| 3,677,437 | 7/1972 | Haigler | 221/7 |
| 3,722,739 | 3/1973 | Blumberg | 221/3 |
| 3,727,794 | 4/1973 | Di Eranco | 221/3 |
| 3,871,156 | 3/1975 | Koenig et al. . | |
| 3,981,398 | 9/1976 | Boshoff | 206/459 X |
| 3,998,356 | 12/1976 | Christensen . | |
| 4,039,080 | 8/1977 | Cappuccili | 206/459 X |
| 4,047,635 | 9/1977 | Bennett, Jr. . | |
| 4,126,247 | 11/1978 | Majka . | |
| 4,127,190 | 11/1978 | Sunnen . | |
| 4,223,801 | 9/1980 | Carlson . | |
| 4,275,384 | 6/1981 | Hicks et al. . | |
| 4,473,156 | 9/1984 | Martin | 206/459 X |

*Primary Examiner*—Joseph J. Rolla
*Assistant Examiner*—Louise S. Heim
*Attorney, Agent, or Firm*—Woodard, Weikart, Emhardt & Naughton

[57] ABSTRACT

An automatic pill dispenser for dispensing medical pills having different prescribed administration schedules includes a plurality of pill storage compartments each capable of holding more than one pill, an automatic release mechanism for dispensing pills at predetermined time intervals corresponding with their respective administration schedules, and a pill receptacle coupled to a pill detector such that a pill dispensed from the pill dispenser and received by the receptacle causes the pill dispenser to generate a signal to alert the patient to take the dispensed medicine. Twelve storage compartments, arranged in a ring about a vertically rotating wheel, are preloaded by a patient with all pills prescribed to be taken during a 24-hour period. The patient loads pills into individual storage compartments according to a loading code corresponding to the respective administration schedules of the pills. The pill dispenser then automatically sequentially rotates the storage compartments over a trapdoor which operates to empty each compartment positioned thereover. A photoelectric detector, having a light beam traveling vertically through a cup into which pills are dispensed, detects pills therein and responds by alerting the patient with an audible or visual signal. The light source also serves as a night light. A preloadable pill storage canister is also disclosed which may be preloaded by a pharmacist and simply inserted into the pill dispenser by the patient for automatic pill dispensing. A method of dispensing medical pills having different prescribed administration schedules is also described.

9 Claims, 7 Drawing Figures

AUTOMATIC PILL DISPENSER AND METHOD OF ADMINISTERING MEDICAL PILLS

BACKGROUND OF THE INVENTION

This invention relates to pill dispensers, and more particularly to automatic pill dispensers capable of dispensing pills having different prescribed administration schedules.

Improper administration of prescribed medication is reported to be the most common reason why some patients do not respond properly to the medical treatment. Patients often simply forget to take their medicine, and complications are sometimes brought on by patients who miss one or more pills and then attempt to "catch up" by taking more than the prescribed dosage. The difficulty in remembering when to take prescribed medication is greater when a patient is prescribed drugs of different types required to be taken at different times. Elderly patients frequently do not have sufficient mental alertness to keep track of the frequencies and dosages of their various medicines over a sustained period of time. Such patients also frequently suffer from impaired manual dexterity, which makes handling of individual tablets and capsules a difficult task which some patients consequently avoid, to their detriment.

Pill storage containers have been developed which hold a patient's supply of medicine and remind the patient when to take the medicine. Hicks et al., in U.S. Pat. No. 4,275,384, shows a portable medicine cabinet with a timer and individual compartments for pill containers. This device alerts the patient when the medicine in a particular canister should be taken, and the patient then physically removes the canister from the cabinet, determines the prescribed dosage and manually removes that dosage from the canister, repeating this process for each canister as often as pills are required to be taken from that canister.

Carlson, in U.S. Pat. No. 4,223,801, shows a multicompartment container which can be filled with one day's requirement of prescribed drugs. Individual compartments are capable of holding pills of different types, and the individual compartments are illuminated when the pills therein are to be taken by the patient. The device is controlled by a timer and a reset switch which is depressed by the patient after taking the required medicine. This apparatus requires an individual to pick pills out of the compartments by hand. Further, this apparatus provides a reset switch which is more easily accessible than the pill storage compartments themselves, thereby providing a weary patient with the temptation of simply pressing the reset button to stop the alarm without taking the medicine.

SUMMARY OF THE INVENTION

The present invention provides an automatic pill dispenser for dispensing medical pills, such as tablets, capsules or suppositories, having different prescribed administration schedules. The pill dispenser according to the present invention includes a plurality of pill storage compartments each capable of holding more than one pill, an automatic release mechanism for dispensing pills at predetermined time intervals corresponding with their respective administration schedules, and a pill receptacle coupled to a pill detector such that a pill dispensed from the pill dispenser and received by the receptacle causes the pill dispenser to generate a signal to alert the patient to take the dispensed medicine. In the preferred embodiment, a photoelectric detector is employed with a light beam traveling through a cup into which pills are dispensed. When the cup is empty and in its proper position, the light path is clear. Any pill dispensed from one of the storage compartments falls into the cup in a position where the light path is blocked, and the dispenser responds by alerting the patient with an audible or visual signal.

In the preferred embodiment, twelve storage compartments are arranged in a ring about a wheel which is rotated at a constant speed over a 24-hour dispensing cycle. A patient preloads the storage compartments with all pills prescribed to be taken during the 24-hour period, loading pills into individual storage compartments according to a loading code corresponding to the respective administration schedules of the different types of pills. The pill dispenser then automatically sequentially empties the storage compartments into the cup and, upon detection of any pill in the cup, alerts the patient to take the dispensed medicine. Each time a patient receives an alert signal during the course of the day, the required response is the same, namely, to remove the cup from the pill dispenser, take the medicine contained therein and return the cup to the pill dispenser. Removing the cup clears the light path again and the alert signal ceases, and when the cup is returned to the pill dispenser empty, the light path remains clear for detection of the next pill delivery.

A pill dispenser according to the invention may be preloaded by the patient himself or may be preloaded by someone assisting the patient once a day, thereby minimizing or totally eliminating the possible confusion as to when to take the prescribed medicine and what dosages to take.

In another embodiment, a preloadable storage canister is provided which may be preloaded by a pharmacist and simply inserted into the pill dispenser by the patient for automatic pill dispensing.

DESCRIPTION OF THE PREFERRED EMBODIMENT

Figure 1:
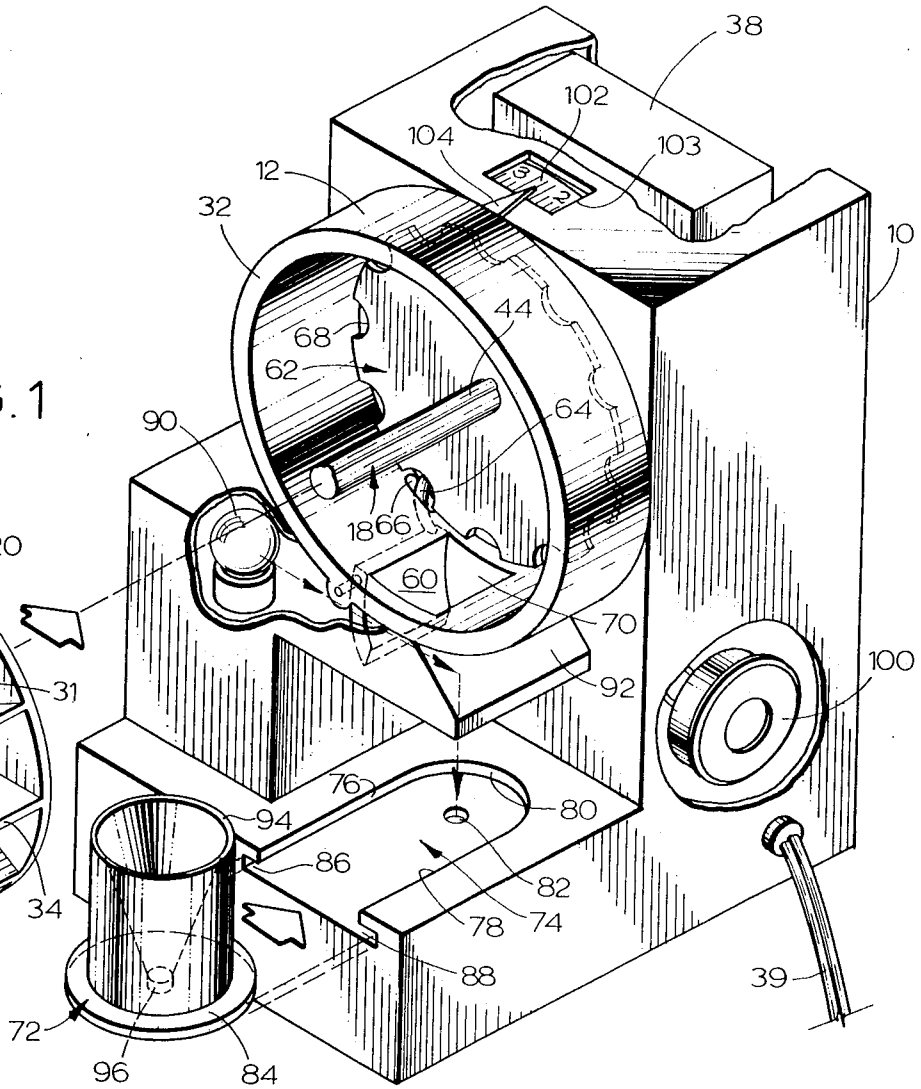
FIG. 1 is an exploded, partial fragmentary perspective view of an automatic pill dispenser according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows an exploded view of an automatic pill dispenser according to the present invention in upright position with portions cut away for ease of explanation. The main housing 10 of the pill dispenser includes a cylindrical housing 12, a pill storage wheel 14 and a front cover 16. Pill storage wheel 14 and cover 16 are slidably received within housing 12 on shaft 18 for automatic dispensing. Pill storage wheel 14 includes a rear faceplate 20, a hub 22, and a plurality of flanges 24 extending from hub 22 to the circumferential edge 26 of rear faceplate 20. Twelve flanges are formed on pill storage wheel 14 to form twelve compartments 28 equally angularly spaced about hub 22 and having rear faceplate 20 as a common rear wall. Medical pills such as tablets, capsules and suppositories are loaded into and sequentially dispensed from various ones of compartments 28 in a manner to be described. Pill storage wheel 14 is positioned within housing 12 with the forwardmost portions of edges 30 of flanges 24 rearward of the forward edge 32 of housing 12 and is sized such that the circumferential edges 34 of flanges 24 and circumferential edge 26 closely fit the inside curvature of housing 12. Thus cylindrical housing 12 provides a common circumferential wall for compartments 28 when pill storage wheel 14 is mounted therein. Flanges 24 each have a tapered base portion 31 to provide a smooth contour between the flanges and hub 22. Edges 30 are tapered forwardly from base portion 31 to circumferential edges 34. It has been found that these tapered portions prevent pills from hanging up on compartments 28 when the pills are to be released therefrom. Front cover 16 is mounted on shaft 18 in contact with the forward edges 30 of flanges 24 as well as hub 22, as may be seen more clearly in FIG. 2. The rear surface 36 of front cover 16 is tapered to conform to the shape of forward edges 30 and hub 22 and to thereby enclose the forward openings of compartments 28. Thus compartments 28 are completely enclosed by housing 12 and front cover 16 when the pill dispenser is ready for use, and pills contained therein are maintained in their respective compartments until they are dispensed.

Referring again to FIG. 1, housing 12 is fixedly mounted to the main housing 10, and shaft 18 is rotatably mounted within housing 12 and driven by a drive motor 38 mounted inside housing 10 to the rear of cylindrical housing 12. Electrical power for drive motor 38 and for the other electrical circuits of the pill dispenser is supplied to housing 10 through input power line 39 which is preferably connected to a standard source of 110 volts AC. Drive motor 38 is preferably connected to shaft 18 through reduction gears internally mounted in the motor unit, the motor and gears being selected to rotate shaft 18 once every 24 hours. Drive units having integral reduction gears are well known in the art and therefore require no further explanation. Shaft 18 extends through hole 40 of pill storage wheel 14, and key 44 engages slot 42 to index pill storage wheel 14 to shaft 18. Key 44 extends forward of forward edge 32 in order to receive a loading guide in indexed relation to shaft 18, as will be described later. Consequently, front cover 16 is provided with a slot 46 in through-hole 48 to receive key 44 when front cover 16 is slidably mounted on shaft 18. The arrangement of the holes and slots in front cover 16 and wheel 14 are illustrated in FIG. 2.

Figure 2:
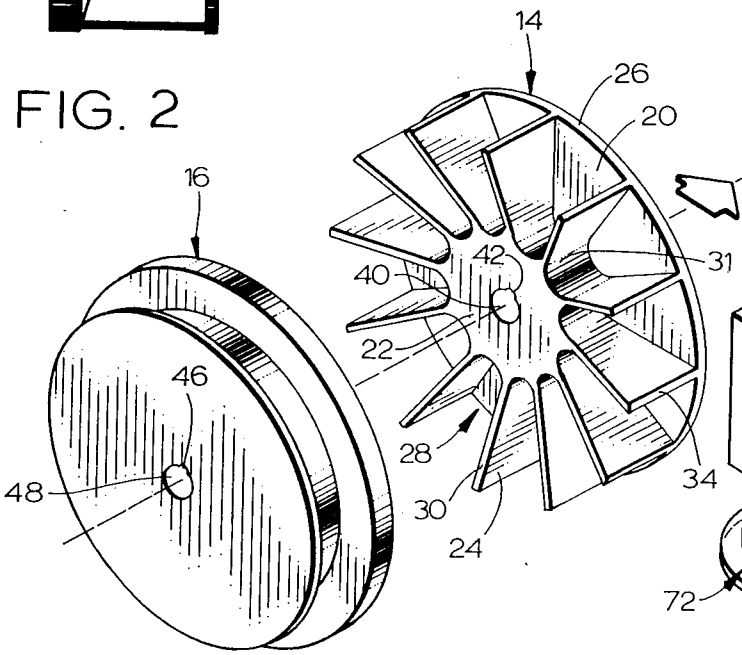
FIG. 2 is a side view of the pill storage wheel and cover of FIG. 1, shown with the cover in contact with the wheel as when installed within the pill dispenser.
Figure 2:
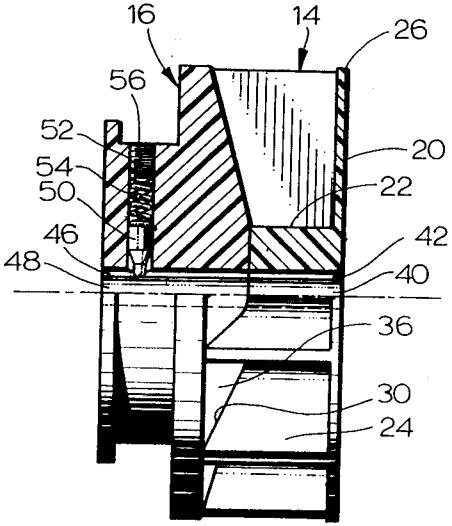

Referring to FIG. 2, friction pin 50 provides a friction fit for front cover 16 on shaft 18. Pin 50 is held in hole 52 against shaft 18 (FIG. 1) by spring 54 which is in turn held in place by set screw 56 threadably engaged in hole 52. Set screw 56 is provided to adjust the amount of friction provided by pin 50.

Referring again to FIG. 1, cylindrical housing 12 is provided with a trapdoor mechanism for releasing pills which, as has been mentioned, are loaded into compartments 28. The trapdoor mechanism includes trapdoor 60, cam 62 and cam follower 64. Trapdoor 60 is pivotally mounted in the bottom of housing 12 and is rigidly connected to cam follower 64. Trapdoor 60 is downwardly biased by its own weight such that cam follower 64, extending upward through slot 66 in housing 12, rests against the circumferential edge of cam 62. Cam 62 is a circular plate having twelve semicircular circumferential slots 68 corresponding with the twelve compartments 28.

During operation, which will be described later, trapdoor 60 is alternately held in an upper position closing aperture 70 and in a lower, released position in which aperture 70 is open. Trapdoor 60 and aperture 70 are sized to span between adjacent circumferential edges 34 of flanges 24 and thereby provide a bottom opening for one of the compartments 28 when positioned over the trapdoor.

The pill dispenser is further provided with a cup 72 slidably received into base 74 of main housing 10. Ridges 76 and 78 in base 74 define a track for guiding cup 72 into position over hole 82. Backstop 80 is provided to stop cup 72 when it is centered over hole 82, thereby enabling fast, accurate placement of cup 72 in the desired position. Baseplate 84 of cup 72 is held within slots 86 and 88 whereby cup 72 is maintained in position when housing 10 is tilted which, as will be described, is necessary for purposes of loading the pill dispenser with pills.

A conventional photocell is positioned below hole 82 in base 74 in the path of a light beam which is generated by light source 90 and reflected downward by mirror 92 as indicated by arrows in FIG. 1. Light source 90 is preferably an incandescent bulb of low wattage, but it will be understood by those skilled in the art that any light source capable of generating a light beam detectable by a conventional photocell may be alternatively used. Cup 72 is tapered inwardly from rim 94 down to hole 96 which extends through baseplate 84. When cup 72 is positioned against backstop 80, hole 96 is vertically positioned in the light path between light source 90 and hole 82. Thus cup 72 forms an operative part of an optical pill detector system. Hole 96 preferably has a diameter less than one-eighth of an inch whereby pills which, as will be described, are emptied into cup 72 during operation of the pill dispenser cover hole 96 and interrupt the light beam normally passing therethrough. Alarm 100 is provided to generate an audible signal in response to interruption of the light beam by a pill contained in cup 72 in order to alert a patient to take the dispensed medicine. It will be appreciated that the light beam may similarly be interrupted by cup 72 being positioned improperly in base 74 such as by careless replacement of cup 72 after removal thereof from base 74, and it is intended that alarm 100 will also alert the patient of this condition in order to assure proper placement of cup 72 for subsequent pill dispensing. Alarm 100 is depicted in FIG. 1 as a buzzer, however it is envisioned that a voice synthesizer may be alternatively housed within housing 10 and programmed to generate an instruction to the patient when the light beam is first interrupted, such as "Please take your medicine." Such a voice synthesizer should be designed not to repeat the message when cup 72 is replaced within housing 12 and could, for example, be programmed to generate an interim instruction such as "Please replace the cup." Additionally, alarm 100 may include a light to visually alert the patient.

Alarm 100 also includes circuitry for alerting the patient of the end of the 24-hour dispensing cycle. This circuitry, which may be time-actuated or switch-actuated, causes alarm 100 to sound continuously until housing 10 is placed on its back for loading. The alarm circuit may be manually reset prior to loading, or may automatically reset upon sensing the change in orientation of housing 10, such as with a mercury switch. In the latter case, alarm 100 is designed, in a conventional fashion, such that, once reset, it only responds to subsequent operation of the photodetector circuit.

Cylindrical housing 12 is preferably transparent so as to permit an individual to visually check the contents of pill storage wheel 14 contained therein. Also, it will be appreciated that trapdoor 60 is preferably transparent so as not to cause interruption of the light beam when positioned in its lower position. Thus the pill dispenser responds to the presence of a pill received by cup 72 rather than to the opening of trapdoor 60, and further responds to the proper replacement of an empty cup 72 into base 74 regardless of the position of trapdoor 60. Housing 12 and trapdoor 60 may be molded from clear plastic.

Drive motor 38 is further provided with a ratchet mechanism whereby shaft 18 may be manually rotated in one direction to any desired position. Main housing 10 further includes a clock dial 102, partially visible through aperture 103, which is indexedly coupled to shaft 18 so as to rotate therewith, and which is numbered to indicate hours of the day. By rotating shaft 18 to a position where pointer 104 points to the correct time of day, the pill dispenser is set to automatically dispense at predetermined times of the day.

The operation of the automatic pill dispenser shown in FIGS. 1 and 2 will now be described. Initially, front cover 16 is manually rotated until pointer 104 indicates the current time. All the pills to be taken during the course of a day are loaded into individual compartments 28 according to their respective administration schedules. The details of the loading procedure will be described later, but it will suffice for present purposes to say that the pills are so loaded and that some compartments may contain several pills while other compartments contain none. Drive motor 38 synchronously rotates pill storage wheel 14 and cam 62 clockwise at a constant rate of one revolution every 24 hours, sequentially positioning individual compartments 28 over aperture 70 and operating the trapdoor mechanism. Cam follower 64 follows the curvature of the circumferential edge of cam 62 as the cam rotates, and trapdoor 60 drops every two hours when one of slots 68 moves over the tip of cam follower 64. The contents of the compartment then positioned over aperture 70 fall through aperture 70 and are guided by trapdoor 60 into cup 72, wherein they are further guided by the tapered inside surface of cup 72 to a position over hole 96. When so positioned, the pills interrupt the light beam normally passing through hole 96, to which the photodetector responds by generating an audible signal through alarm 100. Desirably, upon hearing the signal, the patient responds by removing cup 72 from base 74, thereby clearing the light path and causing the alarm to cease. It should be noted that light source 90 also serves to illuminate the area around cup 72, thus the patient can quickly locate the cup even in a dark room. After taking the medicine contained in cup 72, the patient replaces the cup in base 74. Alarm 100 momentarily sounds as cup 72 is passed through the light path but, when cup 72 is centered over hole 82, the light path is again cleared and the alarm ceases, the pill dispenser then being set for further automatic dispensing into cup 72.

Figure 4:
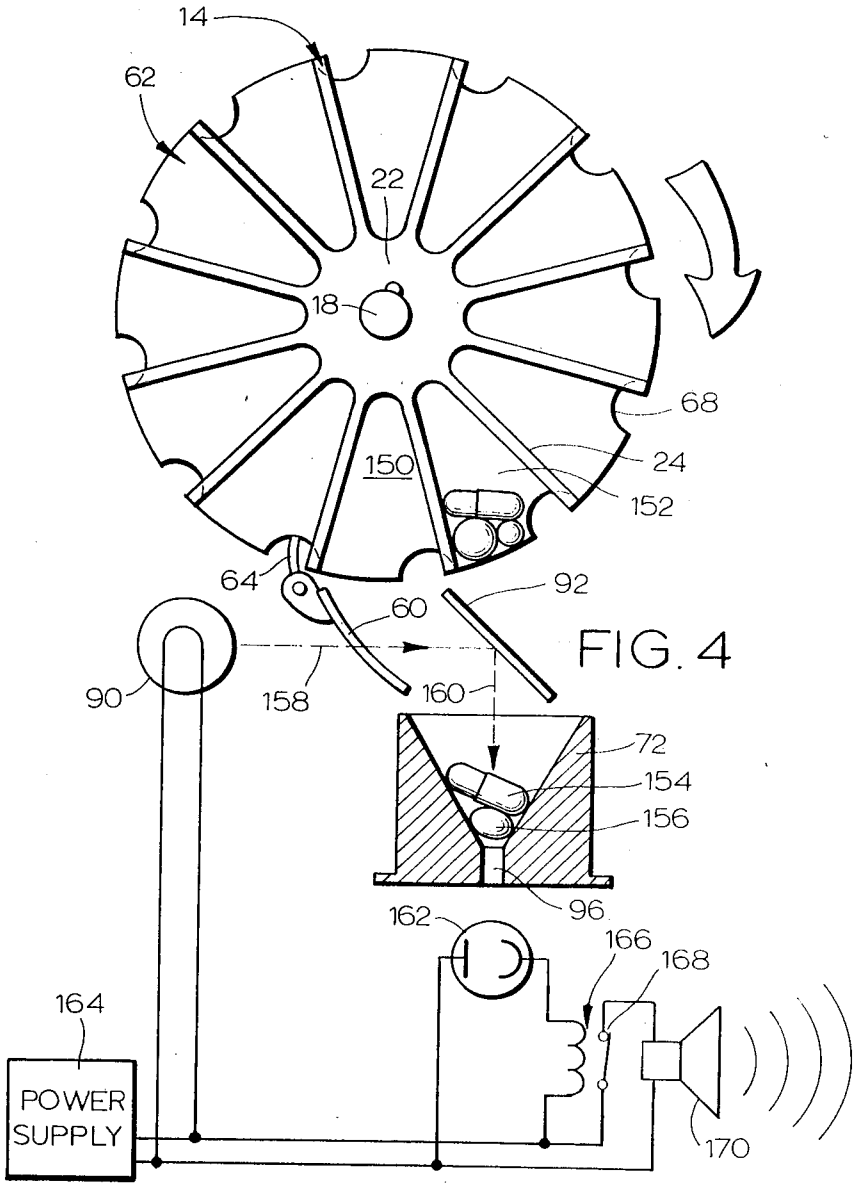
FIGS. 3 and 4 are schematic representations of the automatic pill dispenser illustrating the sequence of operation.
Figure 3:
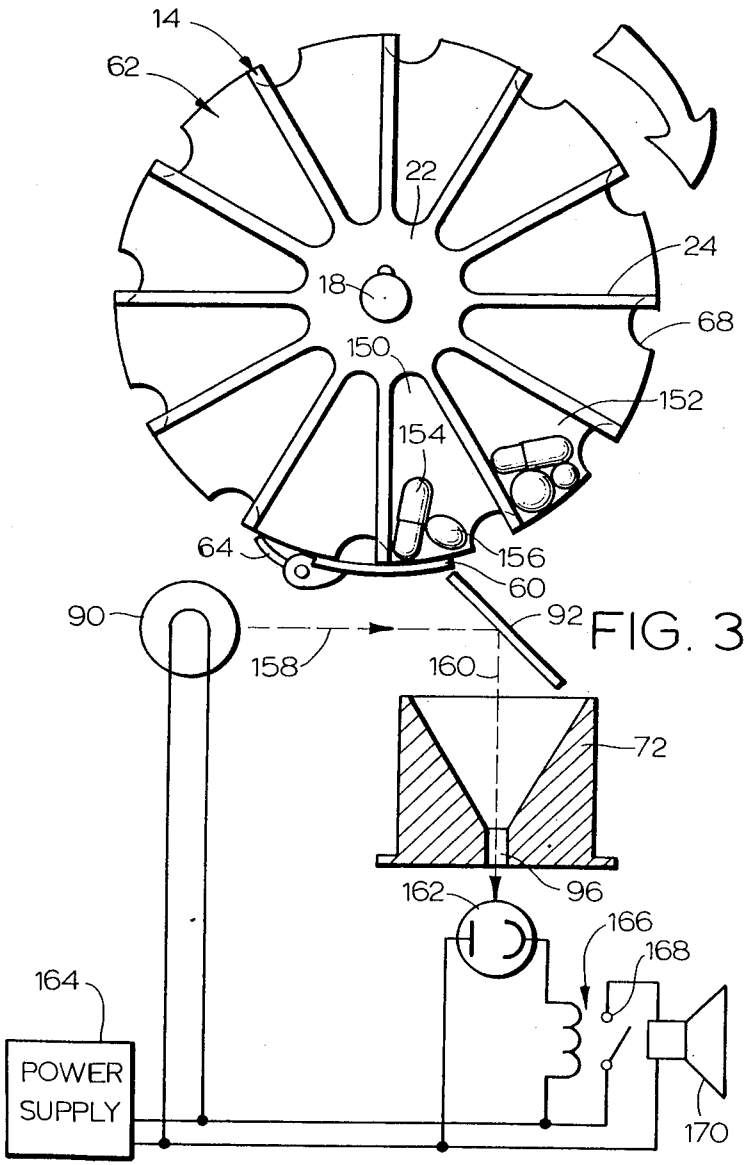

The sequence of operation of the automatic pill dispenser is schematically illustrated in FIGS. 3 and 4, wherein pill storage wheel 14 is shown mounted on shaft 18 with rear faceplate 20 (FIG. 1) removed to illustrate the interrelationship of pill storage wheel 14 and cam 62. Referring to FIG. 3, hub 22 and flanges 24 of pill storage wheel 14 rotate clockwise synchronously with cam 62, each of flanges 24 being indexed to one of slots 68 as shown. Pill storage wheel 14 is shown at a point near the end of a dispensing cycle, with pills contained only in the two compartments 150 and 152. Cylindrical housing 12 (FIG. 1) is not shown, in order to illustrate the operation of cam follower 64. It will nevertheless be understood that the pills contained in compartments 150 and 152 rest against the inside surface of housing 12 and so are held in their respective compartments until those compartments are positioned over trapdoor 60. With pill storage wheel 14 and cam 62 positioned as shown in FIG. 3, cam follower 64 rests against the edge of cam 62 outside of slots 68 and thereby holds trapdoor 60 closed. At this time, capsule 154 and tablet 156 are held within compartment 150 partially over trapdoor 60 and partially over the inside surface of housing 12 (not shown). Light source 90 generates a light beam along path 158 which is reflected by mirror 92 downward along path 160 through hole 96 of cup 72 to photocell 162, which is positioned below hole 82 (FIG. 1). Power supply 164, which supplies the photodetector circuit, may be a direct connection to 110 volts AC or may be derived therefrom, depending on the selection of components for the photodetector circuit. With the light beam from light source 90 impinging upon photocell 162, photocell 162 is rendered conductive thereby energizing relay 166 and opening the normally closed contact 168. With contact 168 open, alarm 170 is disconnected from power supply 164 and is therefore silent.

Referring now to FIG. 4, pill storage wheel 14 and cam 62 are shown after further clockwise rotation from the position shown in FIG. 3. In the position shown in FIG. 4, one of slots 68 in cam 62 has passed the tip of cam follower 64. As soon as this occurs, trapdoor 60 falls open and all the pills contained in compartment 150 (capsule 154 and tablet 156) drop out of that compartment and into cup 72, being guided into cup 72 by trapdoor 60. As the pills fall into cup 72 they are guided by the inside surface thereof, as already described, to a position over hole 96 where they block the light path 160 normally traveling therethrough. With the light path blocked, photocell 162 is nonconductive, therefore relay 166 is de-energized and relay contact 168 is closed, and alarm 170 generates an alarm signal. The relay circuit is preferably nonlatching, so as to allow automatic reset of the photodetector circuit upon removal of cup 72 from the pill dispenser.

Figure 5:
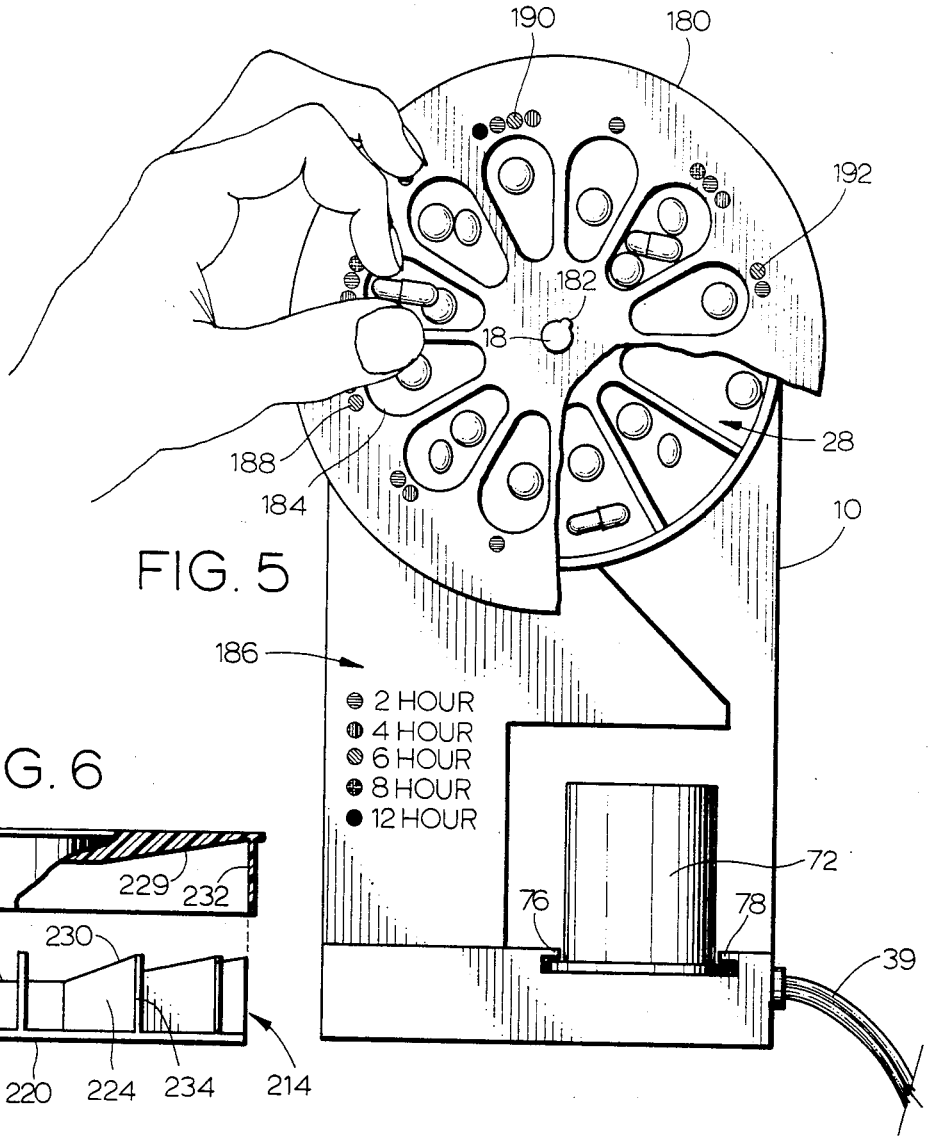
FIG. 5 is a top elevation view of an automatic pill dispenser according to the present invention, shown in pill loading position with a loading guide attached.

Loading of the pill dispenser is accomplished with the aid of a loading guide wheel as shown in FIG. 5. Loading guide 180 is a separate wheel which is mounted on shaft 18 in place of front cover 16 (FIG. 1) for loading of pills into the compartments 28. Loading guide 180 is provided with twelve loading holes 184 corresponding with the twelve compartments 28. Slotted hole 182 indexes loading guide 180 to shaft 18 and thereby aligns particular loading holes 184 with particular compartments 28. Loading guide 180 is marked with a loading code consisting of colored dots arranged adjacent to particular loading holes 184 according to particular prescribed administration schedules, each color representing a different administration schedule. The coding relationship 186 shows the colors for the various administration schedules, designating the schedules by the number of hours between successive pill administrations. Of course, the coding relationship may alternatively be expressed in terms of the number of times per day a pill is to be administered. Coding relationship 186 is preferably indicated on the front surface of main housing 10 as shown in FIG. 5.

Main housing 10 is placed on its back for loading, and pills are loaded into compartments 28 by dropping them through corresponding holes 184 in loading guide 180. Cup 72 is held in position during the loading process by ridges 76 and 78, as has been already described.

As an example of the use of the loading code, colored dots 188, 190 and 192 indicate three of the four loading locations for pills which are to be administered every six hours, or four times a day. A patient desiring to load pills prescribed to be taken every six hours would identify these dots as well as the fourth such colored dot (not shown) by noting the color associated with the 6 hour mark in coding relationship 186, and would drop the pills into the corresponding four loading locations. Similarly, for a particular type of pill prescribed to be taken twelve times a day, that is, at two-hour intervals, the required dosage of that pill is loaded into each of compartments 28, since each compartment is marked with the color corresponding to two-hour intervals.

Figure 6:
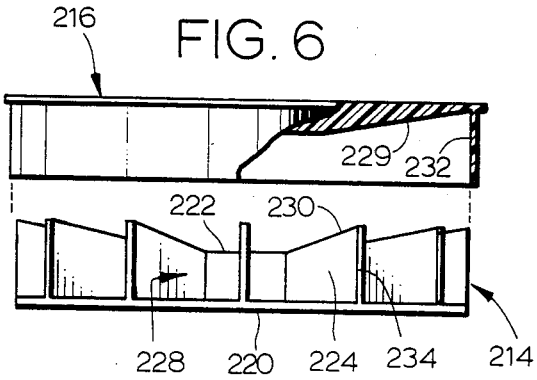
FIG. 6 is an exploded, partial fragmentary side view of a pill canister according to the present invention.

With reference to FIG. 6, a preloadable pill canister may be constructed having a pill storage wheel 214 and a storage cover 218. Pill storage wheel 214 is identical in structure to pill storage wheel 14, already described. It is envisioned that pill storage wheel 214 would be preloaded by a pharmacist or other personnel with the aid of a circular sleeve around the circumference of wheel 214 to enclose the circumferential openings of compartments 228, pill storage wheel 214 being positioned with faceplate 220 in a horizontal plane. The various compartments 228 could be loaded manually, or automatically or semi-automatically with the aid of a coded funnel system suspended over the storage wheel 214, the funnel system including one loading funnel for each compartment. The funnel system might also include, as necessary, guide tubing from each funnel to its respective compartment to enable rapid loading of pill storage wheel 214. It is contemplated that the sleeve surrounding pill storage wheel 214 would abut storage cover 216 when cover 216 is positioned adjacent thereto whereby the sleeve would be displaced by moving storage cover 216 vertically relative to pill storage wheel 214. Storage cover 216 could then be fastened to pill storage wheel 214 by tape or any other conventional fastening technique, and the assembled pill storage canister could then be supplied to a patient for insertion of the preloaded canister into a pill dispenser such as that shown and described above. Storage cover 216 has an inside surface 229 corresponding in shape with edges 230 of flanges 224 and with hub 222, and includes a circumferential wall 232 which closely fits the circumferential edges 234 of flanges 224. Thus storage cover 216 completely encloses the top and circumferential openings of compartments 228. Main housing 10 is placed on its back for insertion of pill storage wheel 214 into cylindrical housing 12 (FIG. 1). Pill storage wheel 214 is slidably mounted onto shaft 18 after first removing the tape or other device fastening storage cover 216 thereto. Wall 232 of storage cover 216 abuts forward edge 32 of housing 12 and is thereby prevented from entering housing 12. Pill storage wheel 214 is simultaneously slidably removed from storage cover 216 and slidably mounted within housing 12 while the circumferential openings of compartments 228 are maintained enclosed. After insertion of pill storage wheel 214 within housing 12, storage cover 216 is set aside or discarded, and front cover 16 is mounted adjacent to pill storage wheel 214 in the manner described above with reference to pill storage wheel 14. The pill dispenser is then ready for automatic dispensing of the preloaded pills. Pill storage wheel 214 is preferably sufficiently slidable within storage cover 216 and housing 12 and on shaft 18 that it slides into position in housing 12 under its own weight. Alternatively, storage cover 216 may be provided with a center through-hole aligned with hub 222 whereby a force may be applied to pill storage wheel 214 to remove it from storage cover 216 and insert it into housing 12.

Figure 7:
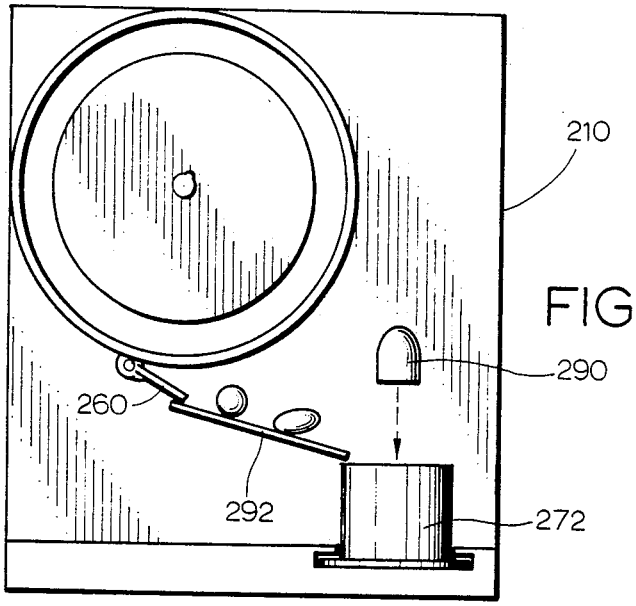
FIG. 7 is a front view of an alternative embodiment of an automatic pill dispenser according to the present invention.

Referring now to FIG. 7, an alternative embodiment of the present invention operates with a straight vertical light beam system. Light source 290 is positioned directly above cup 272, and a chute 292 is mounted on main housing 210 between trapdoor 260 and cup 272 to guide dispensed pills into cup 272. Alternatively, of course, trapdoor 260 may have integrally formed thereon a chute performing the same function as chute 292. The construction and operation of the pill dispenser shown in FIG. 7 is otherwise identical to that of the pill dispenser shown in FIG. 1, and accordingly no further description is necessary.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, by appropriately designing the compartment size and the drive motor speed, the present invention obviously may be incorporated into a pill dispenser capable of dispensing over longer or shorter dispensing cycles.

What is claimed is:

1. An automatic pill dispenser for dispensing medical pills, such as tablets, capsules or suppositories, having different prescribed administration schedules, comprising:

(a) a plurality of pill storage compartments for holding pills having different administration schedules, said compartments each being sized to hold one or more pills;

(b) means for releasing pills from said pill storage compartments at predetermined time intervals corresponding with their respective administration schedules;

(c) a pill receptacle for receiving pills released from said storage compartments; and (d) means for detecting the delivery of a pill into said receptacle and for producing a sensible signal in response thereto, in which said detecting means comprises a photoelectric detector having a light source and photodetector arranged such that delivery of a pill of any commercial size from said storage compartments into said receptacle causes interruption of a light beam generated by said light source, said receptacle is provided with a vertical through-hole of diameter less than one-eighth of an inch, said receptacle includes means for positioning a first pill received from said storage compartments over said hole, and in which said light source and photodetector are arranged such that said light source generates a light beam which normally passes through said hole whereby a first pill received from said storage compartments interrupts the light beam passing through said hole.

2. The automatic pill dispenser of claim 1 in which said receptacle is removable from said pill dispenser, said pill dispenser further comprising:

(e) means responsive to removal of said receptacle for terminating the sensible signal produced in response to delivery of a pill into said receptacle.

3. The automatic pill dispenser of claim 2 in which said releasing means includes means for emptying all of said compartments during a predetermined dispensing cycle, said pill dispenser further comprising:

(f) means for producing a sensible signal in response to completion of said dispensing cycle.

4. The automatic pill dispenser of claim 3 further comprising:

(g) means for coding individual pill storage compartments to indicate loading locations for pills corresponding to their respective administration schedules.

5. The automatic pill dispenser of claim 4 in which said coding means includes a plurality of predetermined unique color patterns respectively corresponding with said administration schedules, said pill dispenser further comprising:

(h) a removable loading guide having thereon said coding means, said loading guide defining inlet holes each corresponding with one of said storage compartments, said loading guide being attached to said pill dispenser with said inlet holes indexed to predetermined storage compartments for loading of pills thereinto.

6. The automatic pill dispenser of claim 5 in which said pill storage compartments are formed on a wheel vertically rotatable within a cylindrical housing, said wheel having a hub, a rim, and a plurality of flanges extending radially between said hub and rim and separating said pill storage compartments; said compartments each have a circumferential opening, said housing being provided with a bottom aperture sized to span one of said circumferential openings; and in which said releasing means further includes drive means for rotating said wheel to sequentially position each of said compartments over said bottom aperture and empty compartments so positioned.

7. The automatic pill dispenser of claim 6 in which said wheel is slidably mountable within said housing, said pill dispenser further comprising:

(i) a removable storage cover attached to said wheel prior to mounting of said wheel within said housing, said storage cover enclosing said compartments when attached to said wheel whereby pills preloaded into individual compartments are maintained therein regardless of the orientation of said wheel.

8. An automatic pill dispenser for dispensing medical pills, such as tablets, capsules or suppositories, having different prescribed administration schedules, comprising:

(a) a cylindrical housing normally disposed with its longitudinal axis in a horizontal plane, said housing having (1) an open forward end, (2) a rear plate, (3) a rotatable central shaft extending axially forward from said rear plate, and (4) a trapdoor mechanism in the bottom of said housing;

(b) drive means for rotating said shaft to predetermined angular positions at predetermined time intervals;

(c) a pill storage wheel slidably indexedly mountable on said shaft within said housing, said pill storage wheel having (1) a circular rear faceplate, (2) a hub connected to the center of said faceplate, and (3) a ring of storage compartments having said faceplate as a common rear end wall and said hub as a common inner wall, said storage compartments being separated by flanges projecting perpendicularly from said faceplate and radially from said hub, said flanges each having an outer edge perpendicular to said faceplate at about its periphery, said faceplate and said outer edges of said flanges closely fitting the inside curvature of said housing when said wheel is positioned therein, said housing and wheel being sized to hold a plurality of pills of different commercial types and sizes in each of said storage compartments when said wheel is within said housing;

(d) a circular cover slidably mountable on said shaft, said cover forming a common front end wall for said storage compartments and closely fitting the inside curvature of said housing when mounted on said shaft adjacent to said wheel;

(e) means for operating said trapdoor mechanism and releasing all pills contained in one of said storage compartments at predetermined time intervals; and (f) a photoelectric detector coupled to said housing for detecting pills released from said storage compartments, in which said drive means is an electric motor operative to continuously rotate said shaft at a fixed speed, said trapdoor operating means includes a rotatable multilobed cam coupled to said drive means, said trapdoor mechanism includes a trapdoor coupled to a cam follower, said cam follower being operatively connected to said cam, and in which said housing further includes a stationary reference point indicator, said pill dispenser further comprising:

(g) a time-indicating dial indexed to said shaft and said storage compartments, said dial having numbers thereon corresponding to hours of the day; and (h) means for overriding said drive means to rotate said dial with respect to said reference point indicator such that said dial indicates the correct time of day.

9. The automatic pill dispenser of claim 8 further comprising:

(i) a cup for receiving pills released from said storage compartments, said cup being provided with a vertical through-hole of diameter less than one-eighth of an inch and including means for positioning a first pill received from one of said storage compartments over said hole, said photoelectric detector detecting interruption of light through said hole by a first pill positioned thereover; and (j) signal means for producing an audible signal in response to detection of said light interruption by said photoelectric detector.

* * * * *